US005474345A

United States Patent [19]

Clark et al.

[11] Patent Number: 5,474,345

[45] Date of Patent: Dec. 12, 1995

[54] DOUBLE PANEL LOCK

[76] Inventors: Hal Clark, 228 W. Sheridan, New Castle, Pa. 16105; Bob Clark, 3550 Chandlerville Rd., Zanesville, Ohio 43701; Kenneth Harcar, 129 Decker Dr., New Castle, Pa. 16105

[21] Appl. No.: 316,103

[22] Filed: Sep. 30, 1994

[51] Int. Cl.[6] ..... E05C 19/00

[52] U.S. Cl. ..... 292/302; 49/67; 292/304

[58] Field of Search ..... 292/302, 304, 292/153, 156, 137, DIG. 19; 49/61, 67

[56] References Cited

U.S. PATENT DOCUMENTS

| | | | |
|---|---|---|---|
| 4,208,837 | 6/1980 | Black, Sr. et al. | 49/67 X |
| 4,784,252 | 11/1988 | Davis | 292/302 X |
| 5,042,854 | 8/1991 | Huang | 292/175 |
| 5,368,346 | 11/1994 | Foster | 292/175 |

*Primary Examiner*—Steven N. Meyers
*Assistant Examiner*—Monica E. Millner
*Attorney, Agent, or Firm*—Richard C. Lithan

[57] ABSTRACT

A locking or latching device for double panels sharing the same opening or frame serves to secure the two panels together, to provide additional security over separate locks or latches for the two panels. The device is particularly adapted to securing two adjacent doors together (e.g., at outer storm door or screen door and a main entrance door for a residence or other structure), but is also adaptable to other double panels or closures, such as windows of various types and their associated shutters. The mechanism comprises a first generally cylindrical component which secures through the outermost panel or door, a second generally cylindrical component which secures through the adjacent relatively inner panel or door and is coaxial with the first component, and a rod which passes coaxially through the two cylindrical components. The rod is captured within the first component and extends through the second component when the two panels are closed and has a series of circumferential slots or grooves therearound. A latch secured to the inner end of the second component engages one of the slots in the rod to prevent its being withdrawn from the second component, thereby securing the two panels together. The multiple slots in the rod provide for adjustability, but still provide for rapid disengagement of the assembly so the doors may be opened quickly in the event of an emergency.

17 Claims, 4 Drawing Sheets

DOUBLE PANEL LOCK

FIELD OF THE INVENTION

The present invention relates generally to latching or locking devices for doors and other movable panels, and more specifically to a locking mechanism which secures or attaches two generally facing panels (e.g., double door system comprising a storm or screen door and a main door of a residence) together, to prevent the opening of the outer panel due to its attachment to the inner panel. The device may be adapted to windows and other relatively movable panels, e.g., shutters, as well as doors.

BACKGROUND OF THE INVENTION

Security for property of various types, particularly home security, is of increasing concern with increasing population pressures and law enforcement agencies finding it increasingly difficult to keep up with the demand for their services due to budgetary constraints. Accordingly, many homeowners are finding it prudent to install additional security devices in their homes, particularly additional locks, latches and the like for entrance doors, windows and other openings into the home.

Most such devices provide security for only a single door or other panel of a common set (such as a screen door and main entrance door), thus requiring the homeowner or other party to purchase two different locks or latches for the two doors. The same holds true for other panels, such as windows and overlying shutters. While various solutions to the above problem have been attempted in the past, none are totally satisfactory.

The need arises for a double panel lock device which provides for the mutual securing together of two facing panels sharing a common opening, such as a storm or screen door and the adjacent main door. The mechanism must be relatively easy and quick to operate for the sake of safety in the event of the need to evacuate the premises quickly, and for the purposes of responding to visitors at the door. At the same time, the mechanism must provide positive security, avoiding the use of additional locks and their required keys and the possibility of a person gaining unauthorized entry by breaking or picking the lock(s). Finally, the double panel lock mechanism must provide for easy adjustment for different spacing between the two panels, i.e., for different weatherstripping thicknesses, etc.

DESCRIPTION OF THE PRIOR ART

U.S. Pat. No. 3,836,187 issued to Larry H. Buettner on Sep. 17, 1974 discloses a Two-Door Lock Device comprising a cable which is secured to one door and which loops around or over the second door to attach thereto. Due to the relatively thin wire and light attachment components, the device would deter only the most casual of attempted unauthorized entries.

U.S. Pat. No. 4,302,907 issued to Jose' M. Canals et al. on Dec. 1, 1981 discloses Selectively Interlocked Double Security Doors. A double acting hinge assembly secures the two doors together along a common hinge axis, allowing the doors to swing in the same direction as they are opened or closed. A relatively complex latch mechanism provides for the securing together of the two doors, or alternatively the latching of one door and opening of the other.

U.S. Pat. No. 4,660,873 issued to Richard J. Sholund on Apr. 28, 1987 discloses a Door Securing Device in which a threaded shaft extends through the inner door to threadibly engage a cooperating fitting on the inner side of the outer door. The shaft is turned by a knob on the inside of the inner door. The need to turn the knob through multiple turns to either engage solidly or disengage the outer door results it a relatively cumbersome mechanism which could be hazardous in the event of the need to evacuate the structure quickly in an emergency.

Finally, U.S. Pat. No. 4,891,907 issued to Mychail Rapaway on Jan. 9, 1990 discloses a Security Lock And Seal For Double Door Or Window Installations. Several embodiments are disclosed, which require either (1) threaded engagement of components, as in the Sholund device discussed above with its limitations, (2) provision for external locking and unlocking with a key, with the accompanying possibility of the lock(s) being picked or broken by a person seeking unauthorized entry, or (3) a cam type engagement of components, which provides relatively rapid engagement and disengagement, but which precludes any adjustability of the spacing between the two doors.

None of the above noted patents, taken either singly or in combination, are seen to disclose the specific arrangement of concepts disclosed by the present invention.

SUMMARY OF THE INVENTION

By the present invention, an improved double panel lock is disclosed.

Accordingly, one of the objects of the present invention is to provide an improved double panel lock which is adaptable to double doors within a common door frame or opening, e.g., an outer screen or storm door and an inner main door for a residence or other structure, and which may also be adapted to other double panels, e.g., windows with their accompanying shutters or other panels.

Another of the objects of the present invention is to provide an improved double panel lock which is completely separate from any of the existing latches and locks of the two doors or panels.

Yet another of the objects of the present invention is to provide an improved double panel lock which adapts to different thicknesses of different panels and spacing therebetween, with no modification of the lock or additional adjustment required.

Still another of the objects of the present invention is to provide an improved double panel lock which allows the folding of the interconnecting component when the lock is not in use.

A further object of the present invention is to provide an improved double panel lock which is actuated entirely from within the second door or panel of the set, and which precludes tampering from the front of the first door or panel.

A final object of the present invention is to provide an improved double panel lock for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
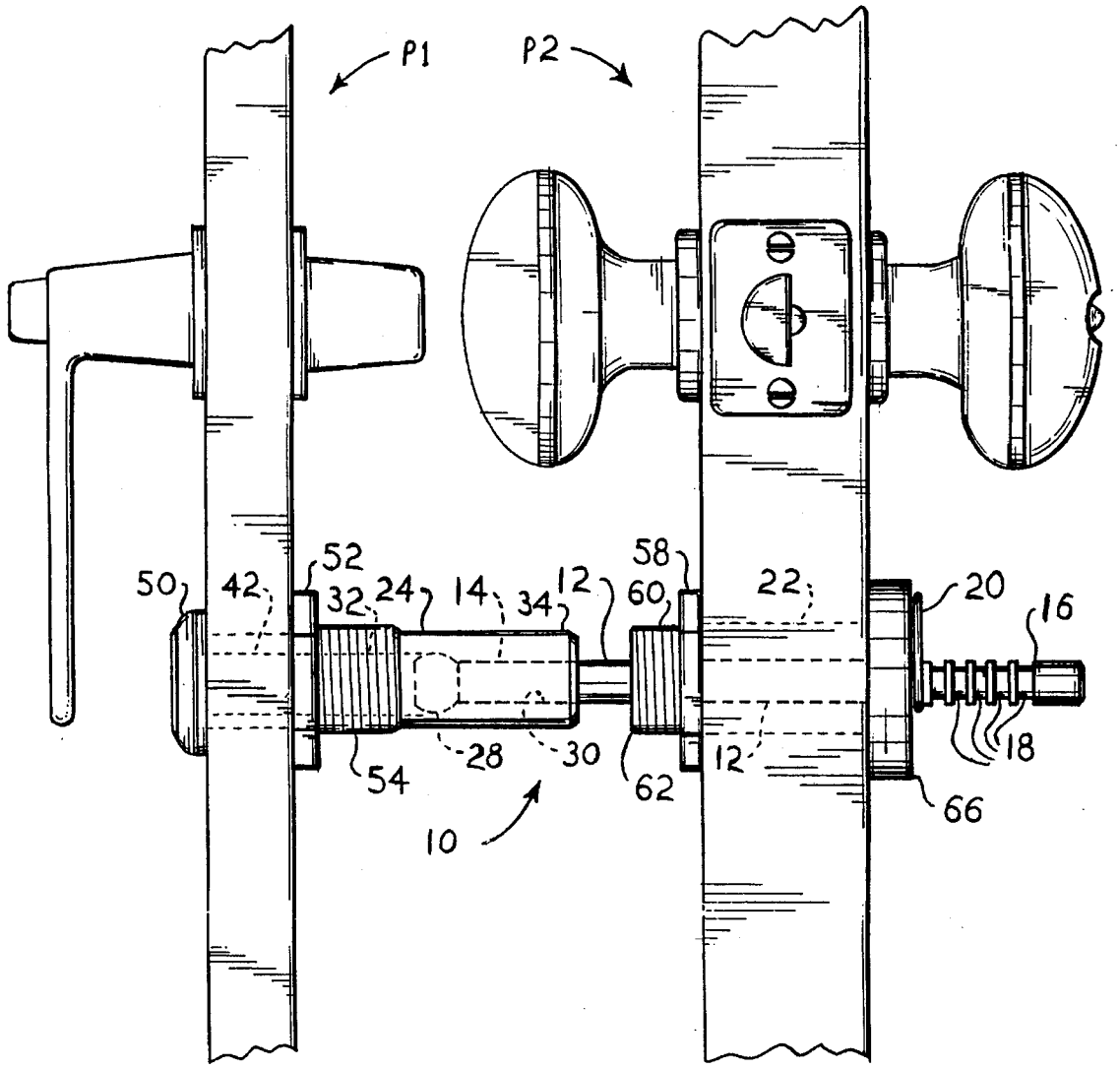
FIG. 1 is a side view of the present double panel lock assembled in a double door set and securing the two doors together.

Referring now particularly to FIG. 1 of the drawings, the present invention will be seen to relate to a double panel lock 10 providing for the positive securing of two facing panels, e.g., an outer first panel P1 (storm door, etc.) and an inner second panel P2 (main door or other panel) together, to preclude the unauthorized opening of the first panel or door. Lock 10 includes a rod 12 which has an attachment end 14 secured to the first panel P1 and extending inwardly therefrom toward the second panel P2, and an opposite latch engaging end 16 which extends through the second panel P2. The latch engaging end 16 includes one or more circumferential grooves 18 therearound, which groove(s) are engaged by a latch plate 20 to secure the assembly together. Preferably, a plurality of grooves 18 are provided to allow for adjustment.

A hollow latch cylinder 22 is secured through the second panel F2, and disposed substantially coaxially with the extended rod 12. Thus, when the two panels P1 and P2 are closed, the latch engaging end 16 of the rod 12 will extend through the hollow latch cylinder 22 so that the latch plate 20 may engage one of the grooves 18 to preclude the withdrawal of the rod 12 from the latch cylinder 22 secured in the second panel P2, and thus securing the panels Pi and P2 together.

Figure 2:
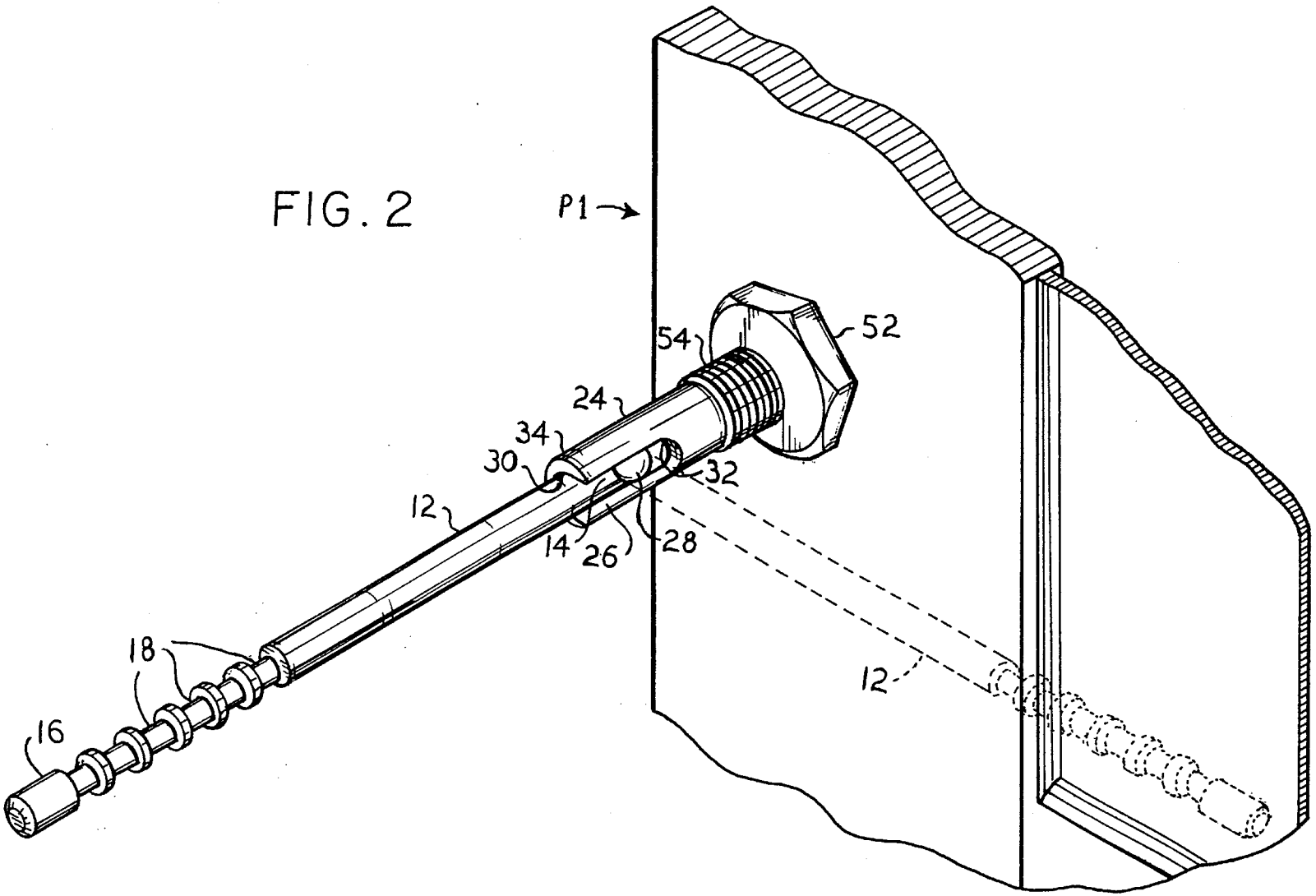
FIG. 2 is a perspective view of the portion of the assembly which extends inwardly from the outer panel, showing the interpanel rod in its extended and folded states.
Figure 4:
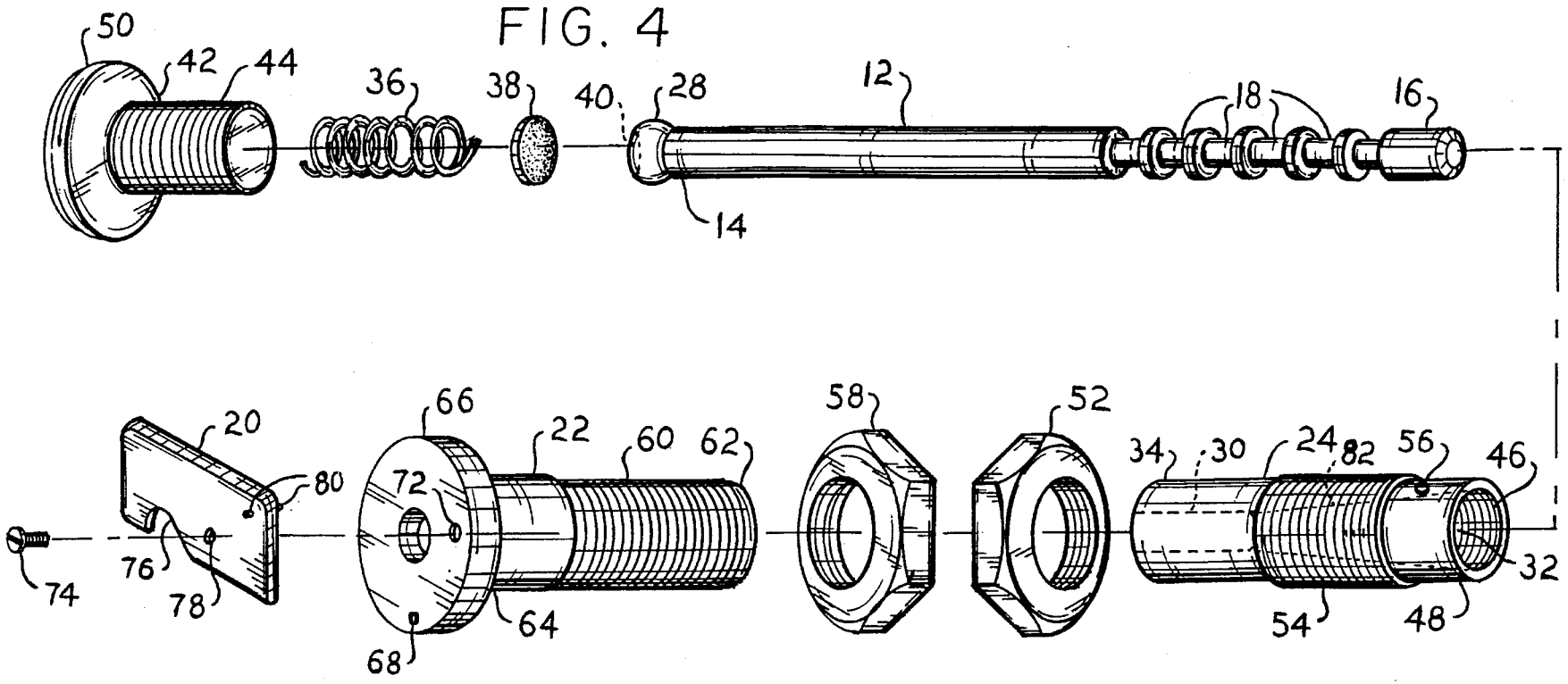
FIG. 4 is an exploded perspective view of the double panel lock assembly, showing its various components and their relationship.

Preferably, the rod 12 is arcuately foldable or retractable to lie along the inner side of the first panel P1, in order to preclude interference with the other panel and/or persons using the doors or panels when the lock 10 is not in use, as shown in FIG. 2. A first panel cylinder 24 includes a longitudinal slot 26 in one side, into which the rod 12 may arcuately fold. The rod 12 is retained within the first panel cylinder 24 by means of a spherical or ball fitting 28 formed on the attachment end 14 of the rod 12; the ball 28 is of a larger diameter than the remainder of the rod 12, and is also larger than the channel 30 through which the rod 12 extends. A larger diameter axial passage 32 is provided from the outer end of the first panel cylinder 24, through which the rod 12 is inserted for assembly of the present double panel lock 10. When the ball fitting 28 reaches the bottom of the larger diameter passage 32, it is captured therein by the smaller diameter channel 30 in the inner end 34 of the first panel cylinder 24; the relationship of these components may be seen in the exploded view of FIG. 4. A compression spring 36 and washer 38 are used to hold the rod 12 in position in the end of the axial passage 32. A flat 40 may be provided on the end of the rod ball 28, which flat serves to center the rod 12 in the extended position until folded.

The first panel cylinder 24 is secured through the first panel P1 by means of a plug 42, which includes threads 44 which mate with the internal threads 46 within the outer end 48 of the first panel cylinder 24. The plug 42 includes a cap 50 preferably formed integrally therewith, and serving to preclude passage of the plug 42 and cylinder 24 assembly through the panel P1, from the outer side to the inner side. A nut 52 threads on to the mating male threads 54 on the outer surface of the first panel cylinder 24 in order to secure the assembly from the inner side of the panel PI. The plug 42 also serves to compress the spring 36 between the end of the plug 42 and the flat 40 on the end of the ball 28 on the rod 12, to hold the rod 12 in the proper position and urge the rod 12 to its extended disposition substantially coaxial with the first panel cylinder 24, unless it is deliberately folded.

The cap 50 will be seen to be smooth, rounded, and devoid of any means providing for the engagement or grip of a tool thereon. Thus, the only externally accessible component of the present lock is the cap 50 extending from the front or outside surface of the first or outer panel P1, and the cap 50 cannot be removed from that side due to its lack of provision for tool engagement therewith. Further security is provided by a set screw 56 (e.g., allen screw, etc.) radially disposed through the side of the outermost end 48 of the first panel cylinder 24. The rod 12, washer 38, and spring 36 are assembled within the cylinder 24, and the plug 42 is threaded into the mating threads 46 of the outermost end portion 48 of the first panel cylinder 24. The set screw 56 is then secured through the side of the cylinder 24, against the plug 42, before the assembly is installed in the first panel P1, to provide further security against the removal of the assembly from the panel P1.

The latch cylinder 22 is installed in the second panel P2 by means of a threaded nut 58 which mates with the threaded portion 60 of the outwardly facing end 62 of the latch cylinder 22. The opposite, inwardly facing end 64 of the cylinder 22 includes a heavy flange 66 thereon, thus precluding passage of the cylinder 22 through the second panel P2 as the nut 58 is tightened. The flange 66 includes a threaded set screw passage 68 therethrough, providing for the insertion of a set screw 70 (FIG. 3) therein, which screw 70 engages the inner surface of the second panel P2 to preclude the turning and inadvertent loosening of the flange 66 (and thus the latch cylinder 24) within the second panel P2. Another threaded hole 72 provides for the pivotal attachment of the latch plate 20 to the flange 66, by means of a screw 74.

Figure 3:
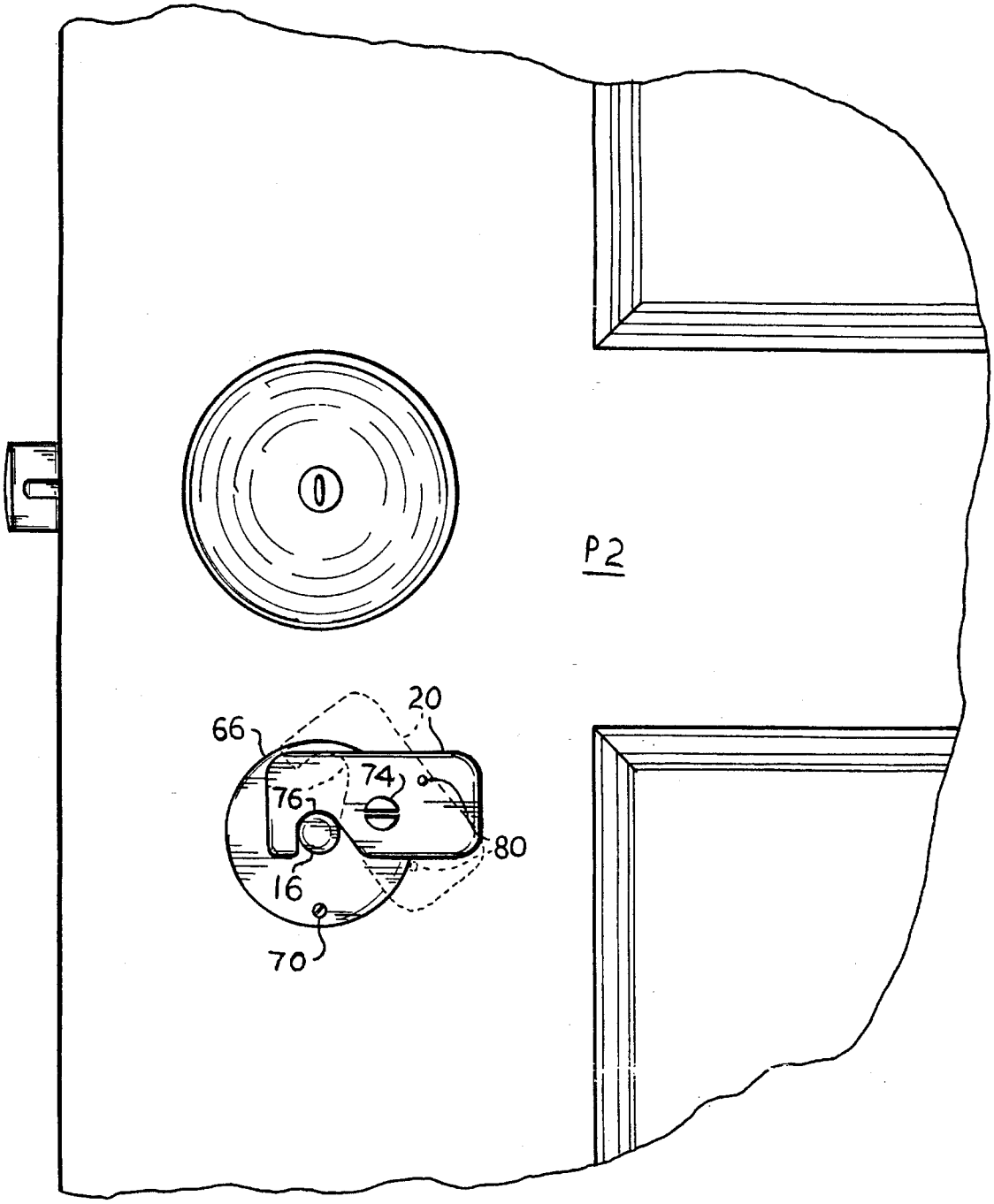
FIG. 3 is a view of the inner panel, showing the operation of the latch on the rod to lock the two panels together.

The operation of the latch plate 20 is shown in FIG. 3. The latch plate 20 includes a cutout 76 therein, which serves to engage one of the rod grooves 18 when the panels F1 and P2 are to be locked together by the present lock 10. The placement of the latch plate attachment screw hole 78 is such that the latch plate 20 is overbalanced and will tend to fall to either side (i.e., for the cutout to fall downward to engage one of the grooves 18, or for the latch plate to pivot outward away from the rod 12), thus ensuring that the position of the latch plate will remain in position as desired, either locked or unlocked. Securing the latch plate 20 to the latch cylinder flange 66 loosely, so that the latch plate is free to pivot as desired, permits the above described operation. Alternatively, the latch plate 20 could be secured to the flange 66 more tightly, so that frictional forces would cause the plate to remain in the desired position. However, the above described loosely pivoting action is desired for rapid actuation, if needed.

In order to preclude the latch plate 20 from falling to a position below the rod 12, a stop pin 80 is provided through the latch plate 20. As the latch plate 20 is pivoted to an unlocked position, as shown by the broken lines in FIG. 3, the pin 80 will engage the edge of the latch cylinder flange 66 to prevent further arcuate motion of the latch plate 20. Thus, the latch plate 20 travel will be no more than approximately 90 degrees, in order to preclude any requirement for excessive movement thereof and to provide for rapid latch engagement and disengagement should such be required. It will be seen that the provision of both a set screw passage 68 and a latch plate screw hole 72 in the latch cylinder flange 66, allows the latch cylinder to be turned over for use with either left or right hand hinged doors or panels, merely by reversing the function of the two holes or passages 68 and 72. Moreover, the latch plate 20 is symmetrical, with the latch plate stop pin 80 extending from both sides, thus allowing the latch plate to be turned over for operation to either side of the flange 66, as desired.

The present double panel lock 10 is preferably formed of a durable material, such as a high grade of steel, with the various components forged and/or machined in order to frustrate any attempts to tamper with the device. The various components may be polished, or plated (e.g., brass, chrome, etc.) as desired, in order to provide an attractive finish for residential use. The first panel cylinder 24, along with the latch rod 12, spring 36, washer 38, and plug 42, are assembled as described above in the first panel P1 with the rod facing inwardly, using the nut 52. The latch cylinder 24, along with the latch plate 20 and appropriate screws, is assembled in the second panel P2 using the nut 58.

When use of the present lock 10 is not desired, the rod 12 may be retracted adjacent the inner surface of the first panel P1, by folding it into the slot 26 provided in the side of the first panel cylinder 24. When it is desired to secure the two panels P1 and P2 together, the rod 12 may be extended, whereupon it will be urged into an extended position essentially coaxial with the first panel cylinder 24 by means of the compressive force of the spring 36 against the flat 40 on the rod ball 28. The two panels P1 and P2 may be closed, and the rod 12 will extend through the hollow interior of the first panel cylinder 24. (The first panel 24 may be provided with all internal conical shape 82 with a relatively wider passage 32 in the outermost end 48 of the cylinder 24, as shown in broken lines in FIG. 4, in order to accept the end 16 of the rod 12 more easily in the event that the two parcels P1 and P2 have some slight arcuate misalignment due to their arcuately hinged closure action.) The end 16 of the rod 12, with its grooves 18 therein, will then extend from the flange 66 of the latch cylinder 22, whereupon the latch plate 20 may be pivotally flipped over to engage one of the grooves 18. (The latch plate 20 is slightly thinner than the width of the grooves, to allow positive engagement therein.) The plurality of grooves 18 provided in the rod 12, provides for adjustment of the distance between the two panels P1 and P2, with the latch plate 20 falling into one of the grooves 18 most nearly coplanar therewith. Thus, the two panels P1 and P2 are positively secured together, as the cutout 76 in the latch plate 20 engaging the rod 12, precludes the withdrawal of the rod 12 through the latch cylinder 22, which is secured in the second panel P2. As the rod 12 is secured in the first panel P1 by the first panel cylinder 24, the two panels P1 and P2 are locked together.

When the two panels P1 and P2 are to be opened, the latch plate 20 may be pivoted or flipped over to the unlatched position, whereupon it will be restricted from excessive travel by the stop pin 80 engaging the periphery of the latch cylinder flange 66. The inner panel P2 may then be opened, with the rod 12 withdrawing from the latch cylinder 22 as the first panel P2 is opened. The rod 12 may then be retracted or folded adjacent the interior surface of the first panel P1, or retained in its extended position, as desired. Thus, the present invention provides a means of securing an outer door or panel to preclude the unauthorized opening thereof, thereby providing even greater security for a homeowner or business owner against the unauthorized opening of storm doors, screen doors, window shutters, and other such panels.

It is to be understood that the present invention is not limited to the sole embodiment described above, but encompasses any and all embodiments within the scope of the following claims.

I claim:

1. A double panel lock in combination with facing first and second panels for providing for the securing of the facing first and second panels together, said lock comprising:

a rod extending inwardly from the first panel, with said rod having an attachment end secured to the first panel and an opposite latch engaging end having at least one circumferential groove therearound;

a cooperating hollow latch cylinder disposed,through the second panel and captured therein and in coaxial alignment with said rod, with said latch cylinder having an outer end and an opposite inner end;

a latch plate pivotally secured to said inner end of said cooperating latch cylinder, with said latch plate having a thickness less than said at least one circumferential groove of said rod and a pivot axis disposed parallel to said latch cylinder, so that said latch plate pivots across said inner end of said latch cylinder, whereby;

the first panel and second panel are positioned in proximity to one another so that said rod extending inwardly from the first panel extends through said hollow cooperating latch cylinder captured in the second panel with said at least one groove of said rod in alignment with said latch plate, and said latch plate is pivotally moved to engage said groove of said rod to preclude the withdrawal of said rod from said latch cylinder and the separation of the first panel and second panel.

2. The double panel lock of claim 1 wherein:

said lock includes adjustment means, comprising a plurality of circumferential grooves formed in said latch engaging end of said rod, whereby;

said rod extending through said latch cylinder has at least one of said circumferential grooves in alignment with said latch plate, and said latch plate engages said one of said circumferential grooves of said rod to secure the first and second panels together.

3. The double panel lock of claim 1 wherein:

a first panel cylinder is disposed within the first panel, with said rod extending coaxially therefrom.

4. The double panel lock of claim 3 wherein:

said first panel cylinder includes a side having a longitudinal slot therein, and said rod is arcuately foldable within said slot to lie against the first panel when said double panel lock is not engaged.

5. The double panel lock of claim 4 wherein;

said first panel cylinder includes means therein urging said rod to an extended position, comprising a compression spring within said first panel cylinder which compressively engages a flat formed on said attachment end of said rod.

6. The double panel lock of claim 3 wherein:

said first panel cylinder includes an outer cap, with said outer cap being devoid of tool engagement means thereon.

7. The double panel lock of claim 3 wherein:

said first panel cylinder includes a generally conically shaped hollow interior having a relatively wider opening at said outer end than at said inner end, whereby;

said relatively wider opening at said outer end of said first panel cylinder provides for ease of insertion of said rod thereinto as the first panel and second panel are arcuately swung together for closure thereof.

8. The double panel lock of claim 1 wherein:

said lock is formed of steel.

9. In combination with a first panel and a facing second panel secured in a single opening, a double panel lock providing for the securing of said first and said facing second panel together, said lock comprising:

rod extending inwardly from said first panel, with said rod having an attachment end secured to said first panel and an opposite latch engaging end having at least one circumferential groove therearound;

a cooperating hollow latch cylinder disposed through said facing second panel and captured therein and in coaxial alignment with said rod, with said latch cylinder having an outer end and an opposite inner end;

a latch plate pivotally secured to said inner end of said cooperating latch cylinder, with said latch plate having a thickness less than said at least one circumferential groove of said rod and a pivot axis disposed parallel to said latch cylinder, so that said latch plate pivots across said inner end of said latch cylinder, whereby;

said first panel and said facing second panel are positioned in proximity to one another so that said rod extending inwardly from said first panel extends through said hollow cooperating latch cylinder captured in said second panel with said at least one groove of said rod in alignment with said latch plate, and said latch plate is pivotally moved to engage said groove of said rod to preclude the withdrawal of said rod from said latch cylinder and the separation of said first panel and said second panel.

10. The double panel lock and panel combination of claim 9 wherein:

said lock includes adjustment means, comprising a plurality of circumferential grooves formed in said latch engaging end of said rod whereby;

said rod extending through said latch cylinder has at least one of said circumferential grooves in alignment with said latch plate, and said latch plate engages said one of said circumferential grooves of said rod to secure said first panel and said facing second panel together.

11. The double panel lock and panel combination of claim 9 wherein:

a first panel cylinder is disposed within said first panel, with said rod extending coaxially therefrom.

12. The double panel lock and panel combination of claim 11 wherein:

said first panel cylinder includes a side having a longitudinal slot therein, and said rod is arcuately foldable within said slot to lie against said first panel when said double panel lock is not engaged.

13. The double panel lock and panel combination of claim 12 wherein:

said first panel cylinder includes means therein urging said rod to an extended position, comprising a compression spring within said first panel cylinder which compressively engages a flat formed on said attachment end of said rod.

14. The double panel lock and panel combination of claim 11 wherein:

said first panel includes an outer surface and said first panel cylinder includes an outer cap disposed upon said first panel outer surface, with said outer cap being devoid of tool engagement means thereon.

15. The double panel lock and panel combination of claim 11 wherein:

said first panel cylinder includes a generally conically shaped hollow interior having a relatively wider opening at said outer end than at said inner end, whereby;

said relatively wider opening at said outer end of said first panel cylinder provides for ease of insertion of said rod thereinto as said first panel and said facing second panel are arcuately swung together for closure thereof.

16. The double panel lock and panel combination of claim 9 wherein:

at least said lock is formed of steel.

17. The double panel lock and panel combination of claim 9 wherein:

said first panel is a storm door and said facing second panel is a main door.

* * * * *